US009180358B2

(12) United States Patent
Heil

(10) Patent No.: US 9,180,358 B2
(45) Date of Patent: Nov. 10, 2015

(54) SNOW GLIDE BOARD

(71) Applicant: Völkl Sports GmbH & Co. KG, Straubing (DE)

(72) Inventor: Tobias Heil, Mitterfels (DE)

( * ) Notice: Subject to any disclaimer, the term of this patent is extended or adjusted under 35 U.S.C. 154(b) by 0 days.

(21) Appl. No.: 14/147,948

(22) Filed: Jan. 6, 2014

(65) Prior Publication Data

US 2014/0191495 A1 Jul. 10, 2014

(30) Foreign Application Priority Data

Jan. 8, 2013 (DE) ..... 10 2013 100 110

(51) Int. Cl.
*A63C 5/048* (2006.01)
*A63C 5/04* (2006.01)
*A63C 5/052* (2006.01)

(52) U.S. Cl.
CPC ..... *A63C 5/0405* (2013.01); *A63C 5/052* (2013.01)

(58) Field of Classification Search
CPC ..... A63C 5/04; A63C 5/0405; A63C 5/0434; A63C 5/0485
See application file for complete search history.

(56) References Cited

U.S. PATENT DOCUMENTS

2002/0158431 A1* 10/2002 Porte ..... 280/14.22

FOREIGN PATENT DOCUMENTS

| | | |
|---|---|---|
| DE | 102 50 020 | 5/2004 |
| FR | 2 804 335 | 8/2001 |
| WO | WO 99/43397 | 9/1999 |

* cited by examiner

*Primary Examiner* — Jeffrey J Restifo
*Assistant Examiner* — Erez Gurari
(74) *Attorney, Agent, or Firm* — Welsh Flaxman & Gitler LLC

(57) ABSTRACT

The invention relates to a snow glide board, especially a ski, having a glide board body with one forward and one rear glide board body end and with a middle glide board section forming a binding section for fastening at least one binding and/or binding plate. The glide board body being designed at least in a partial section on its top side facing away from one glide surface three-dimensionally with a raised section extending in a first axis direction (X axis) corresponding to a glide board longitudinal direction, the raised section is adjoined in a second axis direction (Y axis) toward the longitudinal side of the glide board body by lateral sections, which in a third axis direction (Z axis) perpendicular to the first and second axis direction (X axis, Y axis) and perpendicular to the glide surface have a reduced thickness, the glide board body width in the second axis direction (Y axis) being defined by the sum of the widths of the raised section and the lateral sections.

10 Claims, 3 Drawing Sheets

SNOW GLIDE BOARD

BACKGROUND OF THE INVENTION

The invention relates to a snow glide board. More particularly, the invention relates to a snow glide board with reduced weight and a glide board width that is enlarged perpendicular to its longitudinal extension, therefore making it especially suitable for skiing in deep snow.

SUMMARY OF THE INVENTION

The invention relates to a snow glide board, especially a ski, with a glide board body having one forward and one rear glide board body end with one first glide board section forming a binding section for fastening at least one binding and/or binding plate. The glide board body has at least in a partial section on its top side facing away from one glide surface three-dimensionally with a raised section extending in a first axis direction (X axis) corresponding to a glide board longitudinal direction. The raised section is adjoined in a second axis direction (Y axis) toward the longitudinal side of the glide board body by lateral sections, which in a third axis direction (Z axis) perpendicular to the first and second axis directions (X axis, Y axis) and perpendicular to the glide surface have a reduced thickness. The glide board body width in the second axis direction (Y axis) is defined by the sum of the widths of the raised section and the lateral sections.

It is, therefore, an object of the present invention to provide a large ski body width B combined with a significant reduction of the total weight of the ski body 2. With respect to torsional rigidity and flexural strength, bending or flexing on axes parallel to the Y axis, and mechanical strength, the ski body 2 not only corresponds to a ski body that is very wide in the middle ski body section 2.3 and/or in the binding section and is very narrow at the intermediate ski body sections 2.5 corresponding to the raised section 11, but also the wing-like sections 12 contribute to the torsional rigidity and flexural strength and create the ski body width B necessary for skiing especially in deep snow.

Further embodiments, advantages and possible applications of the invention are disclosed by the following description of exemplary embodiments and the drawings. All characteristics described and/or pictorially represented, alone or in any combination, are subject matter of the invention.

BRIEF DESCRIPTION OF THE DRAWINGS

The invention is described below based on exemplary embodiments with reference to the drawings, in which.

Figure 1:
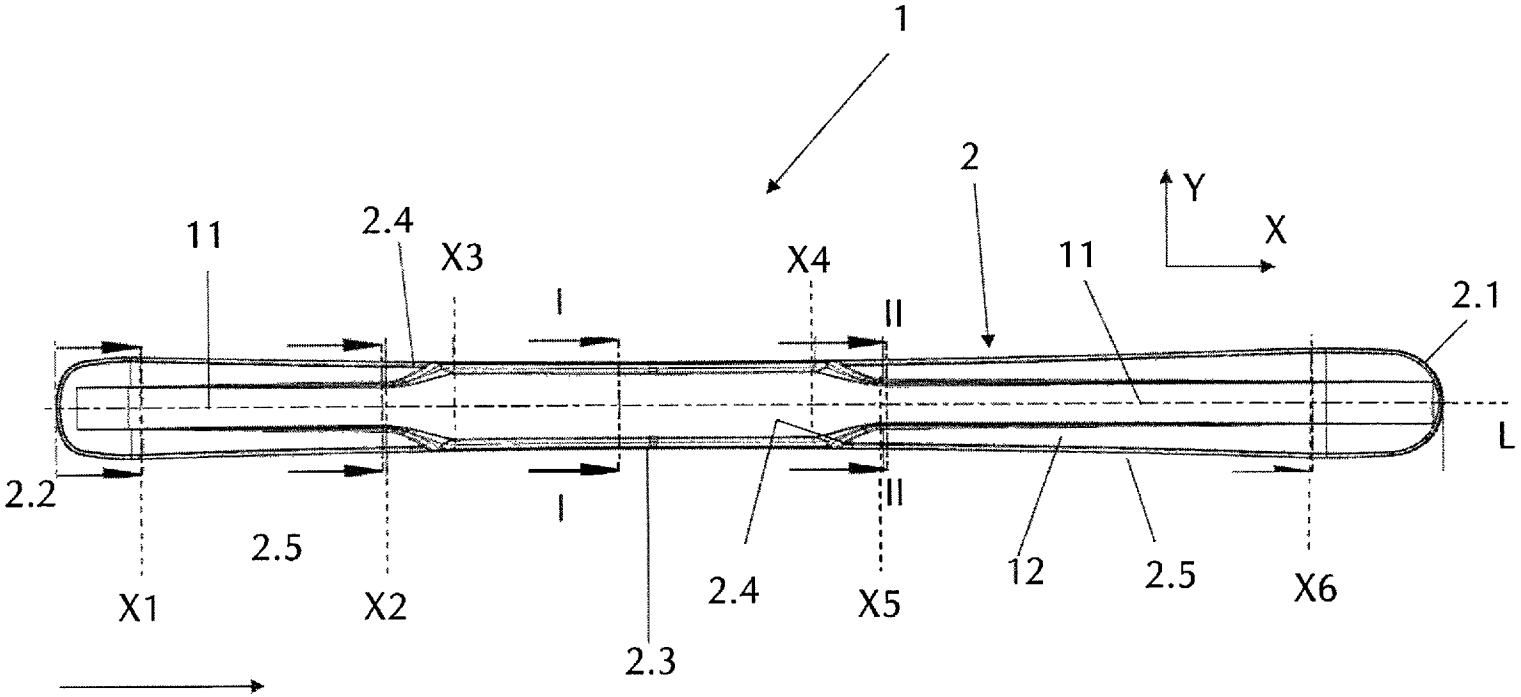
FIG. 1 shows a simplified representation in top plan view of a snow glide board in the form of a ski.

For the sake of simplicity, X, Y and Z in the drawings refer to three spatial axes extending perpendicular to each other, of which the X axis is the longitudinal axis L of the ski body, the Y axis is the width B and the Z axis is the height of the ski body.

DETAILED DESCRIPTION OF THE INVENTION

Referring to the various figures, a ski 1 is disclosed. The ski 1 includes a ski body 2 that is manufactured using normal ski construction materials. The ski body 2 includes a ski body top side 2*t* and a ski body bottom side 2*b*. The ski body 2 includes a front rounded and paddle-like upward curved, i.e. concave on the ski body top side 2*t*, front ski body end 2.1 and a rear rounded and paddle-like upward curved, i.e. concave on the ski body top side 2*t*, rear ski body end 2.2. The ski body 2 further comprises a middle binding and middle ski body section 2.3 for fastening a binding or binding plate (not depicted) thereto. The ski body 2 also includes transition ski body sections 2.4 respectively adjoining the middle ski body section 2.3 to intermediate ski body sections 2.5, which ultimately adjoin to the rear ski body end 2.2 and the front ski body end 2.1. It is appreciated the term "essentially" or "approximately" or "ca." as used in describing the invention means deviations from the exact value by +/−10%, preferably by +/−5% and/or deviations in the form of changes that are insignificant for the function.

Figure 2:
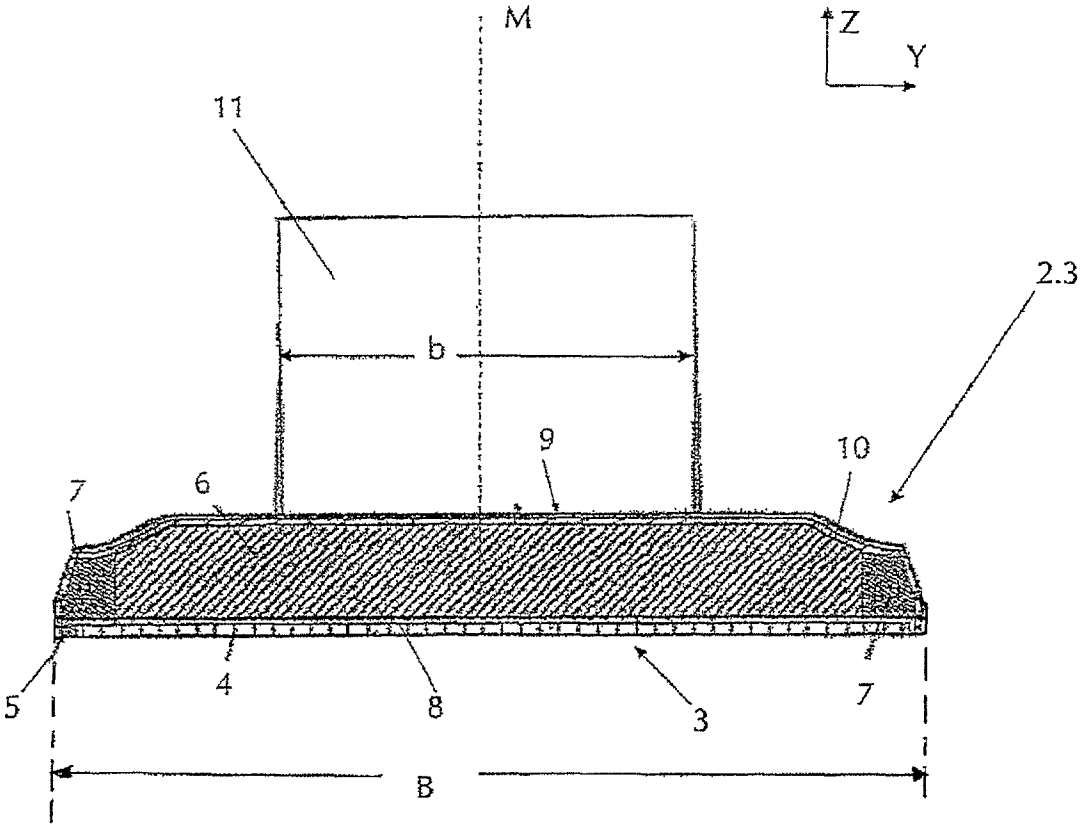
FIG. 2 shows a cross section corresponding to line 1-1 of FIG. 1.
Figure 3:
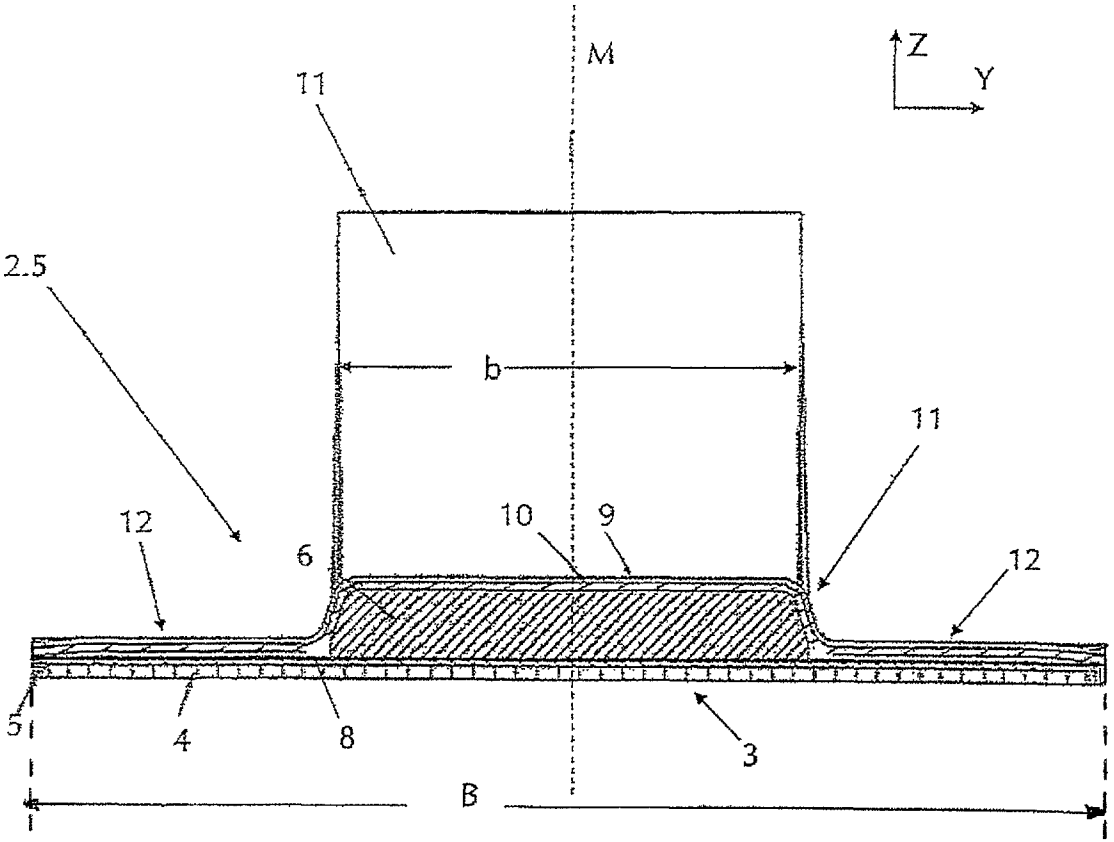
FIG. 3 shows a cross section corresponding to line II-II of FIG. 1.

Referring to FIGS. 2 and 3, a special characteristic of the ski 1 resides in the fact that the ski body 2 has an increased width B over its entire length perpendicular to the ski body longitudinal axis L and/or the X axis. For example, and in accordance with a preferred embodiment, the ski body 2 has a width B greater than 100 mm, namely in combination with reduced width of the ski body 2 as will be appreciate based upon the following disclosure. The increased width B results in a ski 1 is suitable for use as a free-style ski and touring ski, and in particular for skiing in deep snow.

In particular, the ski body 2 comprises the running or glide surface 3 extending on its ski body bottom side 2*t* along the entire width B. The running or glide surface 3 is constructed in a conventional manner and includes a glide surface coating 4 and the two steel edges 5 extending along the longitudinal sides of the ski body 2.

A further component of the ski body 2 is the core 6. The core 6 is composed of wood and/or another suitable material for use as a ski body core, for example, a foamed plastic (in particular, a plastic rigid foam). The core 6 extends along the entire length of the ski body 2 from the front ski body end 2.1 to the rear ski body end 2.2.

As can be seen in FIG. 2, in the middle ski body section 2.3, each of the lateral sides 6.1, 6.2 of the core 6 is provided with one side wall 7. The side walls 7 are supported with their bottom sides arranged in the XY plane directly or indirectly on the respective steel edges 5. At least on this bottom side adjacent to the respective steel edges 5, the side walls 7 are provided with a cross-sectional width in direction of the Y axis that is equal to the width of the steel edges 5 there. The cross section width of the bottom side of the side walls 7 is greater than 50% of the cross-sectional dimension of the side walls 7 on its surface adjacent to the core 6 in the direction of the Z axis. The side walls 7 are composed of a suitable plastic.

Between the glide surface coating 4 and the core 6 there is a lower belt 8, which extends along the entire length of the ski body 2 between the steel edges 5. In accordance with a preferred embodiment, the lower belt 8 is composed of a plastic ply or a layer reinforced with carbon fibers.

The ski body top side 2*t* of the ski body 1 is composed of a plastic layer or shell 9 reinforced by carbon fibers that extend respectively along the entire width B and length of the ski body 2. In accordance with a preferred embodiment the plastic layer or shell 9 also forms the upper belt necessary for the stability of the ski body 2. Under the shell 9, and thereby also partially between the shell 9 and the core 6, there is further an intermediate reinforcing layer 10 of carbon fibers and plastic bonded along the full-surface of the shell 9. The intermediate reinforcing layer 10 extends along the entire width B and length of the ski body 2. The intermediate reinforcing layer 10 directly adjoins the top side 6.3 of the core 6 where the core 6 is present.

In the middle ski body section 2.3, the width B of the ski body 2 is defined by the distance between the two side walls 7 exposed on the longitudinal sides of the ski body 2 in the Y axis. Further, the shell 9 and the intermediate reinforcing layer 10 end in the middle ski body section 2.3 respectively on the top sides 7.1 of the respective side walls 7. The shell 9 and the intermediate reinforcing layer 10 are bonded with the side walls 7 in a suitable manner. Further, in the middle ski body section 2.3, the cross section and, in particular, also the width B of the ski body 2, are defined essentially by the cross section of the core 6.

The core 6, in the depicted embodiment, is shaped on its top side 6.3 facing the ski body top side 2*t* of the ski 1 so that the cross-sectional dimension of the core 6 in the Z axis starting from one side wall 7 first increases, then remains constant or essentially constant over the majority of the width of the ski body 2 and correspondingly decreases toward the other side wall 7. Further, the ski body 2, with respect to its cross section and also with respect to the components used and their arrangement, is mirror symmetric to a middle plane M arranged in the XZ plane and enclosing the longitudinal axis L.

FIG. 3 shows the cross section of the ski body 2 at the intermediately ski body sections 2.5. Although only the intermediate ski body section 2.5 leading to the front ski body end 2.1 is shown, the intermediate ski body section 2.5 leading to the rear ski body section 2.2 is similar. The width B of the ski body 2 there is not defined by the width of the core 6, but instead the core 6 has a significantly reduced width compared with the ski body width B in direction of the Y axis, i.e. the width of the core 6 outside of the middle ski body section 2.3 is significantly less than 50% of the ski body width B, for example 40%-50% of the ski body width B. As can further be seen in FIG. 3, the side walls 7 are missing at the intermediate ski body sections 2.5. The shell 9 and also the intermediate reinforcing layer 10 are guided over the longitudinal sides 6.1, 6.2 of the core 6 extending in the direction of the X axis. The shell 9 and the intermediate reinforcing layer are also bonded full-surface with the lower belt 8 and the glide surface coating 4 to form a multi-layer laminated structure.

Considering the cross section of the ski body 2 being a mirror symmetric to the middle plane M thereof, raised sections 11 are formed on the intermediate ski body sections 2.5, i.e. between the transition ski body sections 2.4 and the front and rear ski body end 2.1 and 2.2 respectively, on the ski body top side 2*t*. The distance between the raised sections 11 defines a width b formed essentially by the core 6. One wing-like section 12 respectively adjoins to each of the raised sections 11 in the direction of the Y axis toward the two longitudinal sides of the ski body 2. Each of the wing-like sections 12 does not comprise the core 6. The width of each of the wing-like section 12 in direction of the Y axis is for example 70%-80% of the corresponding width of the core 6 and/or of the width b. The total thickness of the wing-like sections in the direction of the Z axis is approximately two to three times greater than the maximum dimension of the steel edges 5 in direction of the Z axis. The wing-like sections 12 are comprised essentially of the laminated structure, which is composed of the shell 9, the intermediate reinforcing layer 10, the lower belt 8 and the glide surface coating 4. Further, the wing-like sections 12, in the depicted embodiment, have a constant or essentially constant thickness in the direction of the Z axis along their entire width oriented in the direction of the Y axis and also along the entire length oriented in the direction of the X axis.

As can further be seen in FIG. 3, the core 6 is shaped so that the ski body 2, at the intermediate ski body sections 2.5 themselves on the raised section 11 in the direction of the Z axis, has a thickness that is smaller than the corresponding thickness in the middle ski body section 2.3 and/or binding section. In accordance with disclosed embodiment, the corresponding thickness of the ski body 2 outside of the middle ski body section 2.3 is only about 70% to 85% of the thickness in the binding section.

The design of the ski body 2 described above results in a large ski body width B combined with a significant reduction of the total weight of the ski body 2. With respect to torsional rigidity and flexural strength, bending or flexing on axes parallel to the Y axis, and mechanical strength, the ski body 2 not only corresponds to a ski body that is very wide in the middle ski body section 2.3 and/or in the binding section and is very narrow at the intermediate ski body sections 2.5 corresponding to the raised section 11, but also the wing-like sections 12 contribute to the torsional rigidity and flexural strength and create the ski body width B necessary for skiing especially in deep snow.

The two transition ski body sections 2.4 that directly adjoin the middle ski body section 2.3 respectively form transition areas to the intermediate ski body sections 2.5. That is, at the transition ski body sections 2.4 the wing-like sections 12 increase, or inversely the width b of the raised section 11 there decreases continuously from the width B in the middle ski body section 2.3 to the width b at the ski body sections 2.5.

The middle ski body section 2.3 in the depicted embodiment occupies, together with the transition ski body sections 2.4, approximately 30% to 40% of the total length of the ski body 2. Preferably, the middle ski body section 2.3 occupies, together with the transition ski body sections 2.4, approximately 35% of the total length of the ski body 2. The intermediate ski body section 2.5 extending to the rear ski body end 2.2 has a length that corresponds to approximately 20% to 30%, preferably approximately 24% of the total length of the ski body 2. Preferably, the ski body section 2.5 extending to the front ski body end 2.1 has a length that corresponds to approximately 40% of the total length of the ski body 2.

The ski body 2 has a certain reduction on its longitudinal sides, namely in the form that the width B in the middle of the ski body 2 is smaller than the two front and rear ski body ends 2.1, 2.2. Further, the width b of the raised section 11 in the ski body longitudinal direction changes to a certain extent and the height and/or thickness of the raised section 11 in the direction of the Z axis is reduced starting form the respective ski body section 2.4 toward the front and rear ski body ends 2.1, 2.2, respectively.

The following Table I lists the course of the width B and width b based on the distance X (distance position) from the rear ski body end 2.2. The distance X is indicated as a percentage in relation to the total length of the ski body 2, the width B as a percentage of the maximum width B of the ski body 2 at its front ski body end 2.1 and at the paddle area there, and the width b as a percentage in relation to the width B of the ski body at the respective distance position.

TABLE I

| | Distance X percentage | Width B relative to maximum width B | Width b relative to width B |
|---|---|---|---|
| X1 | 5% | ca. 92% | ca. 40% |
| X2 | 24% | ca. 82% | ca. 48% |
| X3 | 29% | ca. 78% | ca. 100% |
| X4 | 54% | ca. 78% | ca. 100% |
| X5 | 59.5% | ca. 81% | ca. 48% |
| X6 | 93% | ca. 100% | ca. 40% |

The following Table II indicates the course of the width B and width b again in units for a ski body whose length corresponds to 1823 units, one unit preferably being one centimeter.

TABLE II

| | Distance X | Width B | Width b |
|---|---|---|---|
| X1 | 91 units | ca. 132 units | ca. 52.8 units |
| X2 | 434 units | ca. 117 units | ca. 56.2 units |
| X3 | 522 units | ca. 112 units | ca. 112 units |
| X4 | 997 units | 112 units | 112 units |
| X5 | 1084 units | ca. 116 units | ca. 55.7 units |
| X6 | 1695 units | ca. 143 units | ca. 57.2 units |

It is appreciated, the invention is described above based on an exemplary embodiment. It goes without saying that numerous modifications and variations are possible, without abandoning the underlying inventive idea on which the invention is based. It is possible, for example, in order to achieve particular mechanical and/or dynamic properties of the ski body 2, to integrate in the latter additional elements or components, for example to enclose the core 6 with a torsion box consisting of a fiber-reinforced plastic material and/or to provide the upper shell 9 with an outer decorative layer and/or for example to execute the length of the intermediate reinforcing layer 10 in multiple layers at least in partial sections.

REFERENCE LIST

1 ski
2 ski body
2*b* ski body top side
2*t* ski body top side
2.1, 2.2 ski body end
2.3-2.5 ski body sections
3 glide surface
4 glide coating
5 steel edge
6 ski body core
6.1, 6.2 lateral sides
6.3 top side
7 side wall
7.1 top side
8 lower belt
9 upper shell
10 reinforcing intermediate layer
11, 12 section
X, Y, Z spatial axis
M middle plane

What is claimed is:

1. A snow glide board or ski comprising:

a ski body having a front ski body end and a rear ski body end with a middle ski body section forming a binding section for fastening of a binding or binding plate, the ski body having at least in a partial section on a top side of the ski body facing away from a glide surface on a ski body bottom side a three-dimensional raised section extending in a first axial direction (X axis) corresponding to a ski body longitudinal direction (L), the raised section is adjoined in a second axis direction (Y axis) toward a longitudinal side of the ski body by lateral wing-like sections, which in a third axis direction (Z axis) perpendicular to the glide surface, have a reduced thickness, a ski body width (B) in the second axis direction (Y axis) is defined by a sum of the widths of the raised section and the lateral wing-like sections, a core which essentially extends over a length of the ski body, the length comprising a distance including a middle ski body section, two transition ski body sections and two raised sections which extend between the two transition ski body sections and the front and rear ski body end respectively, wherein the core has a width in the second axis direction (Y axis) which defines a width of the raised section, a part of the ski body width (B) occupied by the lateral wing-like sections is greater than the width of the raised section or a thickness of the lateral wing-like sections in the third axis direction (Z axis) is between two or three times a maximum dimension of steel edges provided on longitudinal sides of the ski body, wherein a width (b) of the middle ski body section essentially extends over the width of the snow glide board between the two transition ski body sections.

2. The snow glide board or ski according to claim 1, wherein the ski body in an intermediate ski body section outside of the middle ski body section and between the middle ski body section and the front ski body end or the rear ski body end comprises the raised section and the lateral wing-like sections.

3. The snow glide board or ski according to claim 2, wherein the ski body between the middle ski body section and the intermediate ski body section there is provided a transition ski body section forming a transition.

4. The snow glide board or ski according to claim 3, wherein the middle ski body section together with the transition ski body section occupy 30% to 40% of a total length of the ski body.

5. The snow glide board or ski according to claim 3, wherein the middle ski body section extends to the front ski body end occupying 35% to 45% of a total length of the ski body, or the middle ski body section extends to the rear ski body end occupying 20% to 30% of the total length of the ski body.

6. The snow glide board or ski according to claim 1, wherein the core extends over the entire length of the ski body, the core being provided between a layer forming a top side of the ski body and the glide surface of the ski body.

7. The snow glide board or ski according to claim 6, wherein a reinforcing layer is provided between the layer forming the top side of the ski body.

8. The snow glide board or ski according to claim 1, wherein the lateral wing-like sections are formed by a plurality of mutually connected layers, the plurality of mutually connected layers include at least a shell forming the top side of the ski body, a lower belt and a glide coating of the glide surface.

9. The snow glide board according to claim 1, wherein the ski body has a paddle-like, upward curved section both on the front ski body end and the rear ski body end.

10. The snow glide board or ski as claimed in claim 1, wherein the core extends from the front ski body end to the rear ski body end.

* * * * *